US009680239B2

(12) United States Patent
Boyer et al.

(10) Patent No.: US 9,680,239 B2
(45) Date of Patent: Jun. 13, 2017

(54) GROUNDING STUD AND ELECTRICAL CONNECTIONS

(71) Applicant: Ramco Specialties, Inc., Hudson, OH (US)

(72) Inventors: Mark S. Boyer, South Lyon, MI (US); Gerald P. Downey, Sterling Heights, MI (US); Daniel B. Donovan, Macomb, MI (US)

(73) Assignee: RAMCO SPECIALTIES, INC., Hudson, OH (US)

( * ) Notice: Subject to any disclaimer, the term of this patent is extended or adjusted under 35 U.S.C. 154(b) by 0 days.

(21) Appl. No.: 14/693,132

(22) Filed: Apr. 22, 2015

(65) Prior Publication Data

US 2015/0311601 A1 Oct. 29, 2015

Related U.S. Application Data

(60) Provisional application No. 61/983,270, filed on Apr. 23, 2014.

(51) Int. Cl.

| | |
|---|---|
| ***H01R 4/30*** | (2006.01) |
| ***H01R 4/64*** | (2006.01) |
| *H01R 4/34* | (2006.01) |
| *H01R 11/12* | (2006.01) |
| *H01R 43/02* | (2006.01) |

(52) U.S. Cl.

CPC ..... *H01R 4/64* (2013.01); *H01R 4/34* (2013.01); *H01R 11/12* (2013.01); *H01R 43/0263* (2013.01); *H01R 2201/26* (2013.01)

(58) Field of Classification Search

CPC .... H01R 23/7073; H01R 4/64; H01R 11/283; H01R 11/12; H01R 4/34; F16B 41/002; B23P 19/062

USPC .... 439/80, 92, 766, 883, 801; 411/107, 181; 174/51

See application file for complete search history.

(56) References Cited

U.S. PATENT DOCUMENTS 3,584,667 A 6/1971 Reiland et al.
4,002,390 A * 1/1977 Perry ..... H01R 11/12 439/433

(Continued)

FOREIGN PATENT DOCUMENTS

JP 62-5569 1/1987

*Primary Examiner* — Thanh Tam Le
(74) *Attorney, Agent, or Firm* — Vorys, Sater, Seymour and Pease LLP

(57) ABSTRACT

An electrical connection includes an elongate stud defining a central longitudinal axis, and having a patterned segment, a shoulder, and a flange. The shoulder is generally circular in cross-section having one or more outwardly directed curved surfaces. The shoulder may have an outer continuous curved surface, an outer continuous undulating curved surface, an outer continuous undulating curved surface including alternating sectors of concave and convex regions relative to the longitudinal axis of the elongate stud. Convex regions of the shoulder define corresponding flutes whose cross sections each form a fraction of a first circle, and concave regions define corresponding lobes whose cross sections each form a fraction of a second circle. A diameter or radius of the first and second circles are the same. In an aspect, the diameters or radii of the first and second circles are different. The shoulder may be multilobular, pentalobular, hexalobular or octalobular.

24 Claims, 6 Drawing Sheets

(56) References Cited

U.S. PATENT DOCUMENTS 4,192,215 A 3/1980 Hymans
4,267,870 A * 5/1981 Warner ..... F16B 39/101 411/122
4,808,050 A * 2/1989 Landt ..... F16B 39/282 411/161
5,207,132 A 5/1993 Goss et al.
5,207,588 A * 5/1993 Ladouceur ..... B23P 19/062 29/432.2
5,292,264 A 3/1994 Blank
5,356,253 A * 10/1994 Whitesell ..... F16B 25/0021 411/188
5,413,500 A 5/1995 Tanaka
5,442,133 A * 8/1995 Arnold ..... B23K 35/0288 174/51
5,489,176 A * 2/1996 Fultz ..... B23P 19/062 29/432.2
5,622,464 A * 4/1997 Dill ..... F16B 35/048 411/369
5,655,936 A 8/1997 Meredith
5,868,535 A * 2/1999 Ladouceur ..... B23P 19/062 411/107
5,879,119 A * 3/1999 Robinson ..... F16B 35/048 411/188
6,077,096 A 6/2000 Moring et al.
6,158,310 A 12/2000 Goss et al.
6,206,737 B1 * 3/2001 Bonilla ..... H01R 4/304 411/188
6,244,517 B1 6/2001 Courtois et al.
6,357,110 B1 3/2002 Shipp et al.
6,491,487 B1 12/2002 Wojciechowski
6,607,339 B1 8/2003 Mangapora
6,746,285 B2 6/2004 Delcourt et al.
6,864,015 B2 * 3/2005 Peterson ..... H01M 2/305 429/182
6,991,478 B2 1/2006 Girinon
7,001,125 B2 * 2/2006 Wojciechowski .... F16B 33/004 411/180
7,014,406 B2 * 3/2006 Robertson ..... F16B 35/065 411/161
7,047,617 B2 * 5/2006 Ladouceur ..... B23P 19/062 29/283.5
7,056,161 B2 6/2006 Delcourt et al.
7,083,479 B2 8/2006 Muller et al.
7,241,151 B1 7/2007 Bradshaw
7,425,111 B2 * 9/2008 Ladouceur ..... B23P 19/062 29/432.1
7,568,871 B2 8/2009 Chopp, Jr. et al.
7,597,516 B2 * 10/2009 Bucciferro ..... F16B 5/02 411/162
7,683,254 B2 3/2010 Shimizu
7,713,071 B2 5/2010 Pearce
7,892,049 B1 2/2011 Andler et al.
8,167,262 B2 5/2012 DeDona et al.
8,202,134 B2 6/2012 Moon et al.
8,241,071 B1 * 8/2012 Hayama ..... H01R 4/34 439/709
8,272,883 B1 9/2012 Smith
8,287,219 B2 10/2012 Opper et al.
8,328,486 B2 12/2012 Cox
8,523,505 B2 9/2013 Opper et al.
8,647,159 B2 2/2014 Steeves
8,974,254 B2 3/2015 Esmacher et al.
8,998,549 B2 4/2015 Pimper et al.

* cited by examiner

GROUNDING STUD AND ELECTRICAL CONNECTIONS

CROSS-REFERENCE TO RELATED APPLICATION

This application claims the benefit of U.S. Provisional Application No. 61/983,270 filed on Apr. 23, 2014, the contents of which are incorporated by reference herein in its entirety.

TECHNICAL FIELD

The embodiments herein relate generally to electrical connections and more specifically to grounding stud apparatus, electrical connections including a grounding stud apparatus and a nut, and to electrical connections including a grounding stud, a nut, and a female eyelet configured for electromechanical coupling the stud apparatus with an associated device to be grounded. The example embodiments herein will be described in connection with an electrical connection for an automotive vehicle employing the grounding stud apparatus, but it is to be appreciated that the embodiments are not limited to automotive vehicles and/or automotive applications, but also find use in many other applications including anywhere associated power consuming devices are to be coupled with a grounding member.

BACKGROUND

It is common to arc weld or otherwise attach an elongated circular end of a threaded metal stud onto a sheet metal body panel of an item of equipment such as an automotive vehicle for example for purposes of providing a ground return path through the body panel. Various electrical terminal connections or other parts are then inserted upon the single threaded stud and an internally threaded nut is rotationally inserted onto the stud thereby fastening the terminal ends with the equipment via the stud. Conventional threaded weld studs have also been employed as electrical grounding points for a vehicle wire harness to an engine compartment frame or body panel.

It is also known to employ a grounding weld stud that has a threaded portion, a circular flanged portion and a polygonal shoulder portion for receiving one or more wire harness eyelets having a matching polygonal shoulder portion. The polygonal shoulder portion of the weld stud is typically of an hexagonal or octagonal conformation for receiving the eyelet having a corresponding or equivalent matching hexagonal or octagonal conformation.

The polygonal shoulder configuration of weld studs of this type, however, are difficult to manufacture because they present undesirably large corner-to-corner and flat-to-flat dimensions across the shoulder, and therefore typically do not fit within standard stud welding machinery which can usually only handle a certain maximum outside diameter of stud. In addition, the large corner-to-corner and flat-to-flat dimensions also undesirably limits the number of positions available for mounting the eyelet relative to the stud and associated equipment coupled with the stud. This makes mounting the eyelet onto the stud at a desired relative orientation difficult in some applications.

It is therefore desirable to provide grounding studs and grounding connections without these limitations and, in particular, to provide studs usable with standard stud welding machinery and matable with wire harness eyelets in a much wider range of relative orientations than studs having only flat or polygonal shoulder portions.

BRIEF SUMMARY OF EXAMPLE EMBODIMENTS

In accordance with the embodiments herein, an example embodiment of an electrical connection comprises a grounding stud apparatus having a patterned segment, a shoulder, and a flange. In another aspect of the example embodiment, the shoulder of the stud apparatus has plural curved faces. In a further aspect of the example embodiment, the shoulder of the stud apparatus has an outer face that is void of any flat surfaces. Still another aspect of the example embodiments provides a nut which is threadably engaged with the patterned segment of the stud, and an eyelet which is selectively secured between the nut and the flange of the stud, wherein the eyelet is engagable with the shoulder of the stud apparatus in a wide range of relative positions. Yet another aspect of the example embodiments allows the stud to be welded onto an associated member such as an automotive body panel or the like for use as a grounding stud.

Overall, an embodiment of an electrical connection includes an elongate stud defining a central longitudinal axis, the elongate stud having a patterned segment, a shoulder and a flange. In another aspect of the example embodiment, the shoulder is generally circular in cross-section having one or more curved surfaces directed outwardly relative to the longitudinal axis of the elongate stud. In a further aspect of an embodiment of an electrical connection, the shoulder has an outer continuous curved surface. In a further aspect of the example embodiment, the shoulder has an outer continuous undulating curved surface. In a further aspect of the present invention, the shoulder has an outer continuous undulating curved surface comprising alternating sectors of concave and convex regions relative to the longitudinal axis of the elongate stud. In a further aspect of the example embodiment, the plurality of convex regions of the shoulder define a corresponding plurality of flutes whose cross sections each form a fraction of a first circle, and the plurality of concave regions define a corresponding plurality of lobes whose cross sections each form a fraction of a second circle. In a further aspect of the shoulder of the example embodiment, a diameter or radius of the first and second circles are the same. In a still further aspect of the shoulder of the example embodiment, the diameters or radii of the first and second circles are the different. In a still further aspect of the example embodiment, the shoulder is multilobular. In yet a still further aspect of the example embodiment, the shoulder is pentalobular, hexalobular or octalobular.

The stud and electrical connection of the example embodiments are advantageous over traditional devices in many ways including that the embodiments herein maximize the electrical contact area between the stud and the eyelet while also providing a wide range of set or otherwise predetermined angular orientations to the eyelet and wire once the nut has been fastened onto the stud. The embodiments herein also improve the electrical cross sectional area through the stud while also allowing for the manufacture of the stud in conventionally sized equipment. The preferred multilobular cross sectional shape of the shoulder advantageously increases automatic alignment of the eyelet, especially when the eyelet has a matching octagonal internal aperture shape, as compared to polygonal stud shoulders having six or less flat faces. The stud apparatus of the example embodiments advantageously accepts both a circularly apertured eyelet or a polygonally apertured eyelet such as an octagonally apertured eyelet for example, for use as a grounding stud or for use in other electrical stud connections such as to a junction box, battery or the like.

Additional advantages and features of the embodiments herein will become apparent from the following description and appended claims, taken in conjunction with the accompanying drawings.

BRIEF DESCRIPTION OF THE DRAWINGS

The foregoing and other features of the embodiments herein will become apparent to those skilled in the art to which the present grounding stud apparatus and electrical connections relate, upon reading the following description with reference to the accompanying drawings, in which.

DETAILED DESCRIPTION OF EXAMPLE EMBODIMENTS

Figure 1:
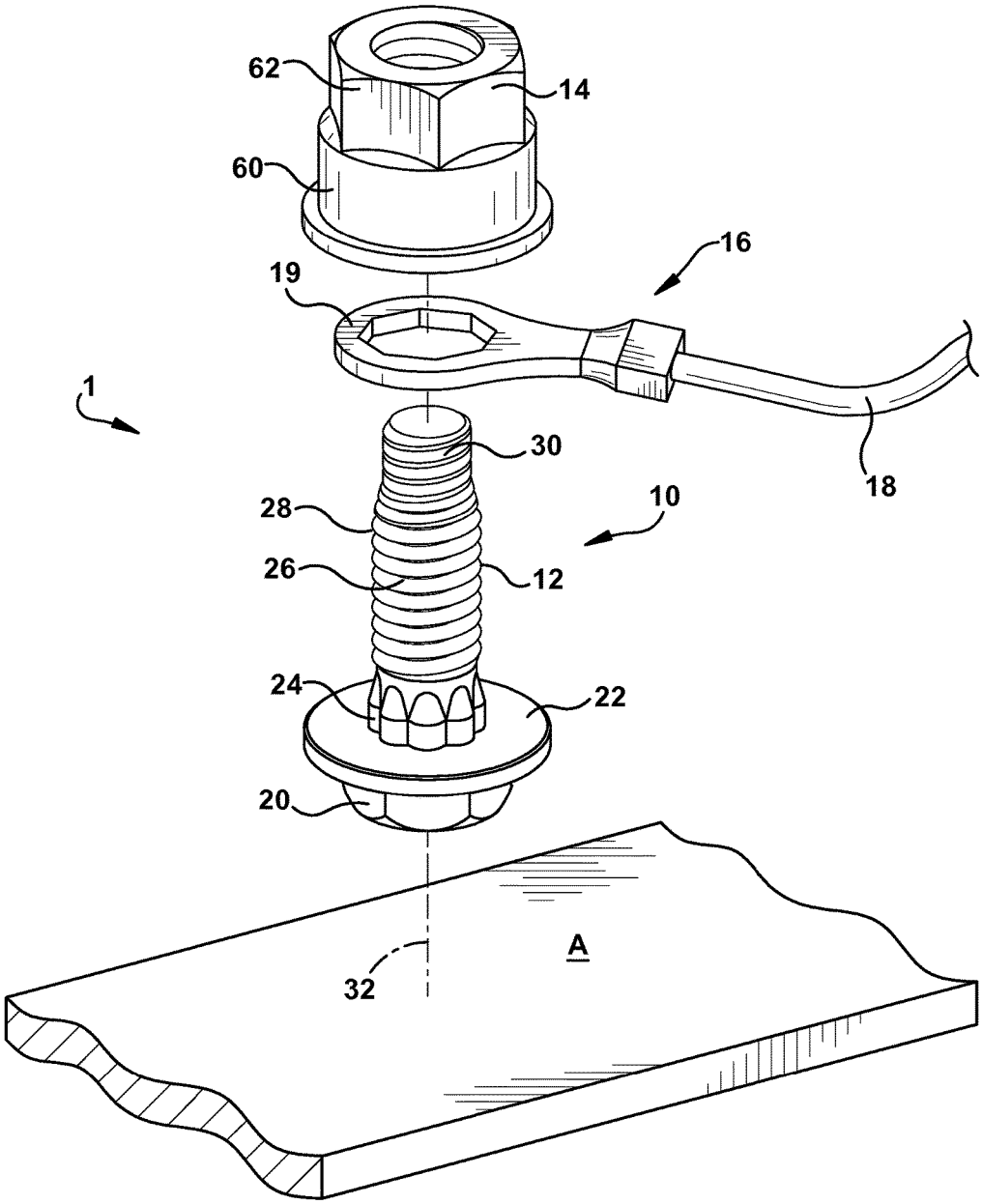
FIG. 1 is an exploded view showing an example embodiment grounding stud apparatus and electrical connection.
Figure 2B:
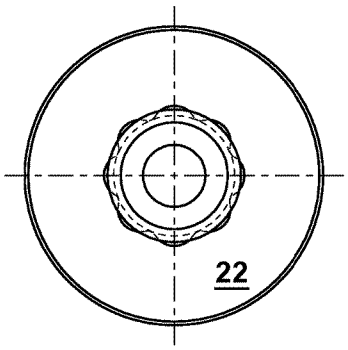
FIG. 2B is a second end view of the stud shown in FIG. 2 taken along line 2B-2B of FIG. 2.
Figure 2:
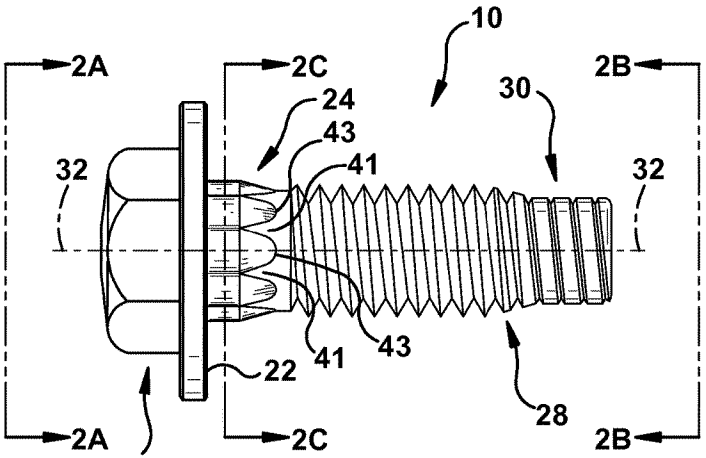
FIG. 2 is a side elevational view of the elongate stud of the electrical connection of the example embodiment of FIG. 1.
Figure 2A:
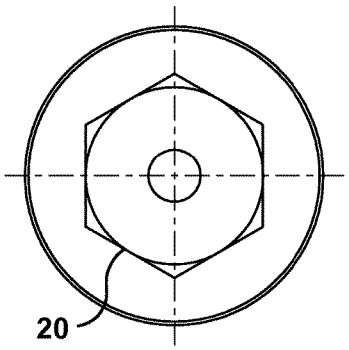
FIG. 2A is a first end view of the stud shown in FIG. 2 taken along line 2A-2A of FIG. 2.
Figure 2C:
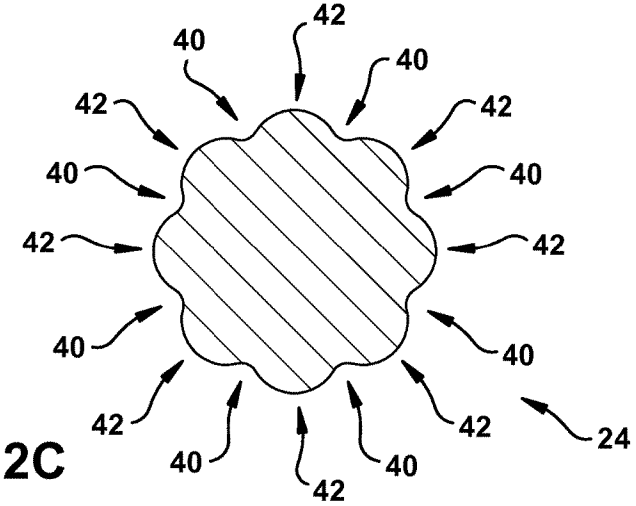
FIG. 2C is a cross-sectional view of the stud shown in FIG. 2 taken along line 2C-2C of FIG. 2.
Figure 3B:
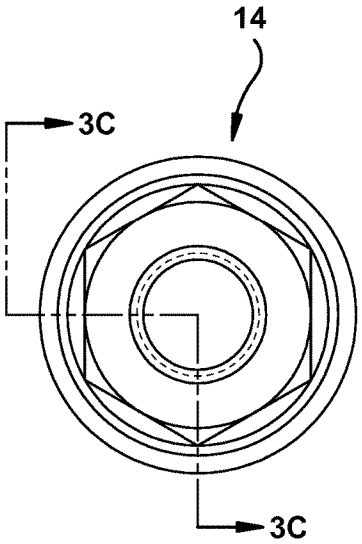
FIG. 3B is a second end view of the nut shown in FIG. 3 taken along line 3B-3B of FIG. 3.
Figure 3:
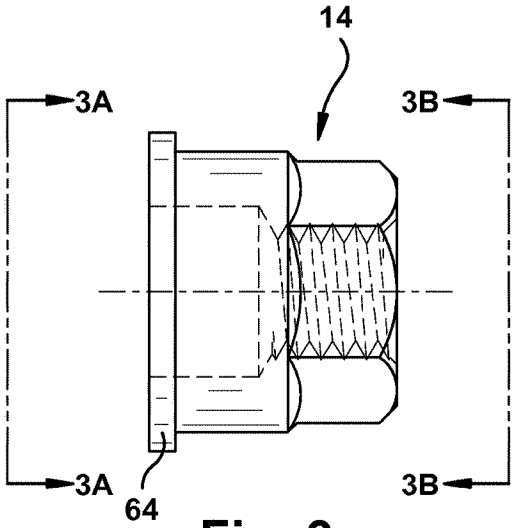
FIG. 3 is a side elevational view of the nut of the electrical connection of the example embodiment of FIG. 1.
Figure 3C:
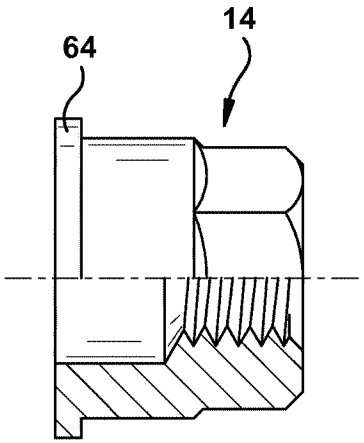
FIG. 3C is a partial cross-sectional view of the nut shown in FIG. 3 taken along line 3C-3C of FIG. 3B.
Figure 3A:
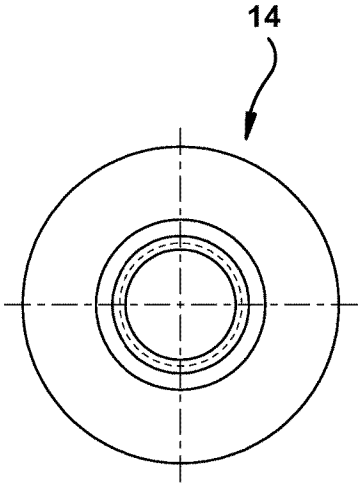
FIG. 3A is a first end view of the nut shown in FIG. 3 taken along line 3A-3A of FIG. 3.
Figure 4B:
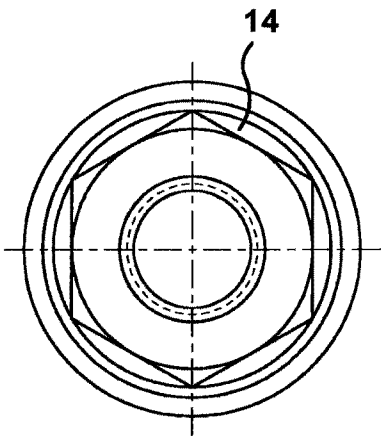
FIG. 4B is a second end view of the stud and nut shown in FIG. 4 taken along line 4B-4B of FIG. 4.
Figure 4:
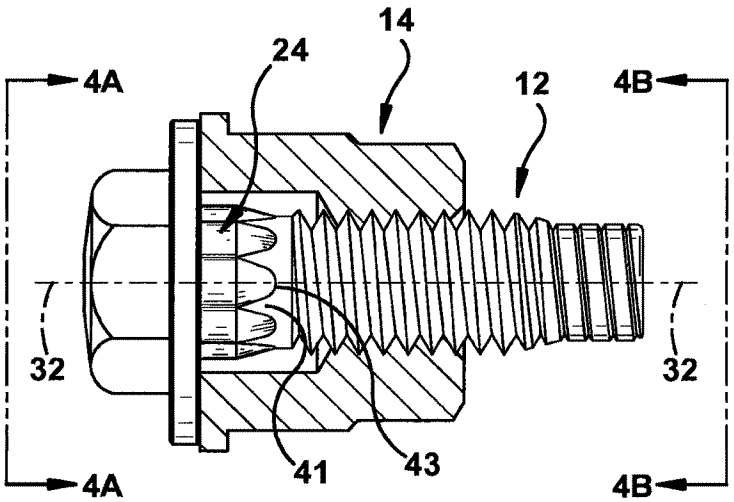
FIG. 4 is a partial cross-sectional view of the stud shown in FIG. 2 with the nut shown in FIG. 3 disposed thereon, in an operative clamped or tightened position relative to the stud.
Figure 4A:
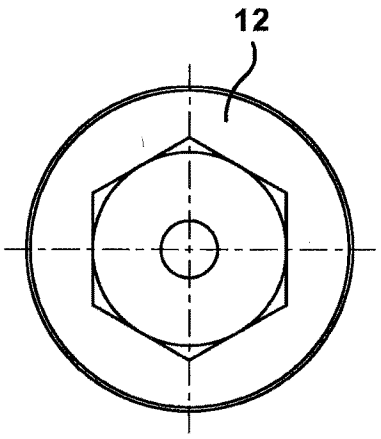
FIG. 4A is a first end view of the stud and nut shown in FIG. 4 taken along line 4A-4A of FIG. 4.
Figure 5:
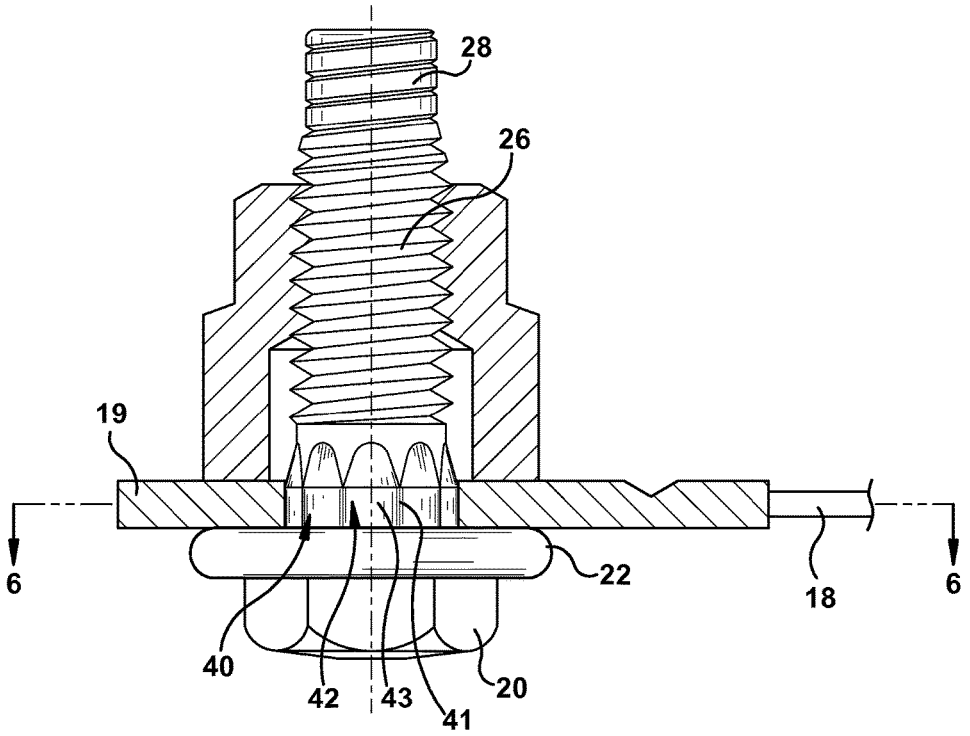
FIG. 5 is a side elevational view, taken partially in cross-section, showing the stud and electrical connection of the embodiment of FIG. 1 in an operative assembled position.
Figure 6:
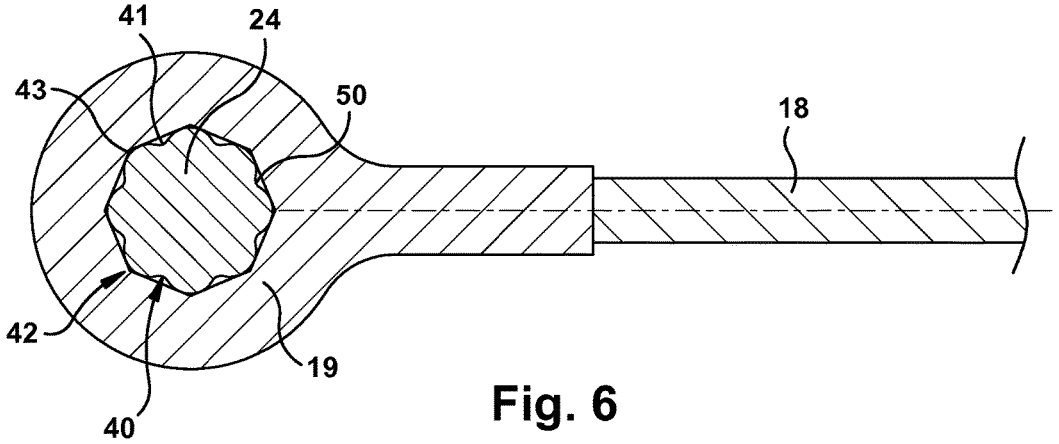
FIG. 6 is a cross-sectional view taken along line 6-6 of FIG. 5 showing an embodiment of an eyelet received onto the stud of FIG. 2.
Figure 7:
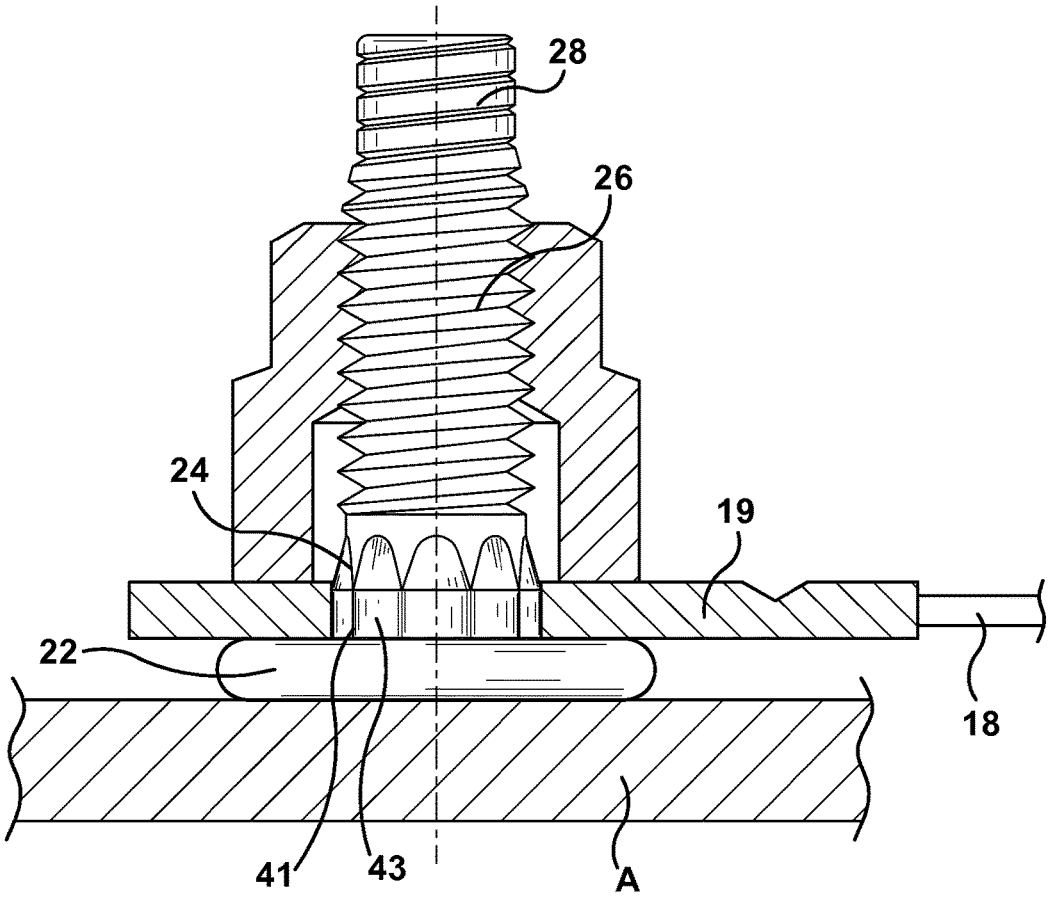
FIG. 7 is a side elevational view, taken partially in cross-section, showing a further example embodiment stud and electrical connection of the embodiment of FIG. 1 in an operative position fully mounted to a vehicle body panel.

With reference now to the drawing Figures, wherein the showings are for purposes of describing the embodiments only and not for purposes of limiting same, example embodiments herein relate to grounding stud apparatus and to electrical connections including the grounding studs wherein portions of the grounding studs define regions having plural curved surfaces configured to extend into an opening of an eyelet and selectively engage corresponding regions of the eyelet having for attachment therewith in a wide range of relative positions. The embodiments herein are applicable to different fastener constructions having various non-flat surfaces as may be necessary or desired. As representative of the embodiments and with reference in particular first to FIG. 1, an electrical connection 1 of the example embodiment is shown employed relative to an associated electrically conductive panel A of an item of equipment such as for example a panel of in an engine compartment of an associated automotive vehicle. The electrical connection 1 of the example embodiment is operable to conduct electricity between electrical components of the associated equipment and/or automotive vehicle, such as a battery, direct current window wiper motor, horn, power distribution box or the like, and a conductive metal panel A or frame of the equipment or vehicle.

Referring to FIGS. 1-7, the example embodiment grounding stud electrical connection 1 includes, in general, a grounding weld stud apparatus 10 having an elongate generally cylindrical body 12, a nut 14, and an electrical terminal connector 16. In the embodiment illustrated, the electrical terminal connector 16 includes an electrically conductive wire 18 branching from an associated wire harness (not shown), with a metal eyelet 19 crimped onto an end thereof. Wire 18 is made of a flexible copper inner wire surrounded by an insulative casing.

The grounding stud apparatus 10 includes a securing segment 20, a flange 22, a shoulder 24, a patterned segment 26, an inwardly tapered segment 28 and an anti-cross-threading lead-in end segment 30. The securing segment 20, flange 22, shoulder 24, patterned segment 26, inwardly tapered segment 28, and anti-cross threading lead-in end segment 30 are disposed at selected positions along a longitudinal centerline 32 of the generally cylindrical body 12. In the embodiment illustrated, the securing segment 20 has a hexagonal cross-sectional shape with a centrally raised button. This portion forms the weld pool of material when the grounding stud 10 apparatus is drawn arc welded to panel A. Flange 22 has a circular peripheral shape and transversely extends beyond the rest of stud 10.

In accordance with the example embodiment, the shoulder 24 is defined by a set of alternating generally convex 40 and concave 42 regions that are connected together and surround the longitudinal centerline 32 of the grounding stud 10 apparatus. However, it is to be appreciated that the shoulder may be generally characterized as being circular in overall cross-section and having one or more curved surfaces directed outwardly relative to the longitudinal axis 32 of the elongate stud. In a further aspect of an embodiment of the electrical connection, the shoulder 24 has an outer continuous curved surface. In a further aspect of the example embodiment, the shoulder 24 has an outer continuous undulating curved surface. In yet a further aspect of the present invention, the shoulder has an outer continuous undulating curved surface comprising alternating sectors of concave and convex regions relative to the longitudinal axis of the elongate stud. That is, working the way around the circumference of the shoulder 24, a concave section 42 is encountered, then a convex section 40 is encountered, then a concave section 42 is encountered, then a convex section 40 is encountered, and so on around the circumference of the shoulder 24. In general, in the embodiment illustrated, the each concave region defines a lobe and, correspondingly, each convex region defines a flute.

In the example illustrated, the first series of convex sections 40 and the second series of concave sections 42 extend in the axial direction along the length of the shoulder 24. Each convex section 40, as shown in the drawings, takes the form of an unthreaded flute 41 formed from a curved surface which is directed radially outwardly away from the centerline 32 of the stud 10 and which is generated by an ellipse, preferably a circle. Similarly, each concave section 40, as shown in the drawings, takes the form of an unthreaded lobe 43 formed from a curved surface which is directed radially inwardly toward the centerline 32 of the stud 10 and which is generated by an ellipse, preferably a circle. As shown and preferably, the alternating concaved and convexed elliptically, preferably circular, curved surfaces merge smoothly and tangentially thereby defining the series of alternating flutes 41 and lobes 43. Both the lobes and flutes are, in general, elliptically curved in section. Preferably, the lobes and flutes are circularly curved in section and, also preferably, the centers of the circularly curved lobes and correspondingly the centers of the circularly curved flutes are disposed at the apexes of regular octagons, although not the same octagon, due to the alternating nature of these components.

In addition to the above, while the example embodiment of the grounding stud apparatus 10 includes eight (8) convex sections 40 and eight (8) concave sections 42, it is to be appreciated that any number of convex and concave sections 40, 42 may be provided on or defined by the shoulder 24 as may be necessary or desired. For example, sets of five (5), six (6), seven (7), nine (9), etc. convex and concave 40, 42 regions may be provided for cooperative coupling with the eyelet 19 of the terminal connector 16 having a corresponding or equivalent conformation.

The center of each ellipse which is used to form the respective flutes 41 is radially equidistant from the centerline 32 of the body 12 of the stud apparatus 10. Each section 42, as shown in the drawings, takes the form of an unthreaded lobe 43 formed from a curved surface which is directed radially outwardly from the centerline 32 of the body 12 of the stud 10 and which is generated by an ellipse, preferably a circle. The center of each ellipse (preferably a circle) which is used to form the respective lobes 43 is radially equidistant from the centerline 32 of the body 12 of the stud 10. As such, the flutes 41 are recessed toward the centerline 32 of the stud 10 relative to the lobes 43. Adjacent curved surfaces which forms the respective flutes 41 and lobes 43 merge generally tangentially and smoothly with each other. The configuration of alternating flutes 41 and lobes 43 defines the external configuration of the shoulder 24 of the grounding stud apparatus 10. The flutes 41 and lobes 43 are equally spaced around the circumference of the drive head 24 and, in the illustrated embodiment, eight (8) flutes 41 are provided in the first series, and eight (8) lobes 43 are provided in the second series. The centers of the ellipses used to form the flutes 41 define a circle with respect to the centerline 32 of the body 12 of the stud 10 and the centers of the ellipses used to form the lobes 43 define a circle with respect to the centerline 32 of the body 12 of the stud 10. These circles may overlap each other or may be offset from each other.

Preferably, the lobes 43 and flutes 41 in the example embodiment are circularly curved in cross section.

The eyelet 19 in accordance with the electrical connection of an example embodiment has an internal aperture 50 defined by a radially inwardly facing edge, preferably an octagonally shaped edge. Aperture 50 of eyelet 19 closely matches the size of shoulder 24, and close dimensional tolerances of aperture 50 and of the flutes 41 and lobes 43 comprising the shoulder 24 are important.

Nut 14 has a circular-cylindrical, enlarged section 60 and a reduced section 62 mutually coaxially arranged with the enlarged section 60. A hexagonal cross sectional shape is externally provided on reduced section 62 for selective engagement with an associated socket or wrench tool, while a spiral thread is internally disposed within reduced section 62 for engaging the threads of stud 12. Enlarged section 60 has, on an end thereof, a radially outwardly directed flange member 64 which selectively abuts against and compresses eyelet 19 against flange 22 of stud 10, when nut 14 is rotatably tightened by a torque wrench or the like upon stud 10. In the fully fastened position, enlarged section 60 of nut 14 externally surrounds and covers at least part of shoulder 24. Alternately, nut 14 is of a progressive torque, crown lock variety.

In the electrical grounding stud application, stud 10, with nut 14 preassembled to prevent e-coat and paint incursion, is first welded to panel A. Subsequently, nut 14 is removed. Next, eyelet 19 is manually placed around threaded segment 26 of stud 10. Nut 14 is thereafter rotatably driven onto stud. The rotation of nut 14 will cause the octagonal aperture 50 of eyelet 19 to become automatically aligned with the matching flutes 41 and lobes 43 of the octagonal shoulder 24, thereby allowing a fixed orientation of eyelet 19 and wire 18 relative to stud 10. Nut 14 is then fully torqued onto stud. It is believed that the shape maximizes the face-to-face dimension and also the corner-to-corner dimension of shoulder 24. Notwithstanding, the cross sectional dimensions of shoulder 24 still allow for manufacturing of stud 10 in conventionally sized processing equipment. Additionally, the multilobular cross sectional shape of shoulder 24 allows for reduced circumferential rotation or angular displacement of the corresponding eyelet before alignment is achieved, especially compared to hexagonal or square cross sectional shapes.

An alternate embodiment eyelet has a circular internal aperture which fits around the lobes. This eyelet configuration (not shown) is more suitable for electrical connections, such as for junction boxes or batteries, where locked in wire orientation is not as important.

While the example embodiment grounding stud and electrical connection have been disclosed, it should be appreciated that other aspects can be employed within the scope of the embodiments. For example, the securing segment of the stud can alternately have a screw thread, be suitable for spot welding or have an interference fit type push in configuration to the adjacent panel or member. Additionally, the internal nut threads can be replaced by inwardly projecting formations that are in a non-spiral configuration. Furthermore, nut 14 can be replaced by a crimped on collar. The stud electrical connection can also be used for non-automotive apparatuses such as household appliance, power tools or industrial machines. While various materials have been disclosed, other materials may be employed.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

Having thus described the example embodiments, it is now claimed:

1. A grounding stud apparatus for use with a nut having a hole and defining an internally threaded section therein, and an eyelet having a polygonal aperture therethrough, the grounding stud apparatus comprising:

an elongate substantially cylindrical body member defining a longitudinal centerline;

a threaded segment spiraling around the longitudinal centerline of the body member, the threaded segment being configured for coupling with the internally threaded section of the nut;

a shoulder located adjacent the threaded segment, the shoulder comprising plural continuous curved surfaces comprising a set of circumferentially alternating concave and convex sectors surrounding the longitudinal centerline and that are configured to be received into the polygonal aperture of the eyelet for engaging with the eyelet, the plural curved surfaces being arranged circumferentially uninterrupted relative to the longitudinal centerline; and an elongated flange located adjacent the shoulder opposite the threaded segment, wherein:

the polygonal aperture of the eyelet defines an inscribed diameter and a circumscribed diameter that is larger than the inscribed diameter, and the shoulder defines a circumscribed diameter of the shoulder that is larger than the inscribed diameter of the eyelet and smaller than the circumscribed diameter of the eyelet;

the concave sectors of the shoulder contact adjacent sides of the polygonal aperture of the eyelet; and the convex sectors of the shoulder are spaced apart from corners formed between the adjacent sides of the polygonal aperture of the eyelet.

2. The grounding stud apparatus according to claim 1, wherein:

the set of circumferentially alternating concave and convex sectors define a corresponding set of circumferentially alternating lobes whose cross sections each form a fraction of a first circle and flutes whose cross sections each form a fraction of a second circle, the circumferentially alternating lobes and flutes defining a substantially multilobular cross sectional shape.

3. The grounding stud apparatus according to claim 2, wherein:

cross sections of the lobes each form a fraction of the first circle having a first diameter; and cross sections of the flutes each form a fraction of the second circle having a second diameter different than the first diameter.

4. The grounding stud apparatus according to claim 2, wherein:

cross sections of the lobes each form a fraction of the first circle having a first diameter; and cross sections of the flutes each form a fraction of the second circle having the first diameter.

5. The grounding stud apparatus according to claim 2, wherein:

centers of each first circle defined by the set of circumferentially alternating lobes are radially equidistant from the centerline of the body member of the grounding stud apparatus; and centers of each second circle defined by the set of circumferentially alternating flutes are radially equidistant from the centerline of the body member of the grounding stud apparatus.

6. The grounding stud apparatus according to claim 1, wherein:

the set of circumferentially alternating concave and convex sectors define a corresponding set of circumferentially alternating lobes whose cross sections each form a fraction of a first ellipse and flutes whose cross sections each form a fraction of a second ellipse, the circumferentially alternating lobes and flutes defining a substantially multilobular cross sectional shape.

7. The grounding stud apparatus according to claim 6, wherein:

centers of the first ellipses of the lobes define a first circle with respect to the centerline of the body member of the grounding stud apparatus; and centers of the second ellipses of the flutes define a second circle with respect to the centerline of the body member of the grounding stud apparatus.

8. The grounding stud apparatus according to claim 7, wherein the first and second circles overlap each other.

9. The grounding stud apparatus according to claim 7, wherein the first and second circles are offset from each other.

10. The grounding stud apparatus according to claim 1, wherein: the plural curved surfaces define a corresponding set of one or more circumferentially alternating i) lobes whose one or more cross sections each form a fraction of a first ellipse; and ii) flutes whose one or more cross sections each form a fraction of a second ellipse, wherein the set of one or more circumferentially alternating lobes and flutes define a substantially multilobular cross sectional shape.

11. The grounding stud apparatus according to claim 1, wherein the elongated flange is transversely larger than the shoulder and the threaded segment, and the flange has a substantially circular peripheral shape.

12. The grounding stud apparatus according to claim 1, wherein:

the set of circumferentially alternating concave and convex sectors define a corresponding set of circumferentially alternating lobes and flutes, wherein each of the lobes have a cross section forming a fraction of a first circle.

13. The grounding stud apparatus according to claim 1, wherein:

adjacent surfaces of the plural curved surfaces of the shoulder merge smoothly and tangentially relative to the longitudinal centerline of the body member thereby defining a series of alternating lobes and flutes.

14. The grounding stud apparatus according to claim 13, wherein:

the lobes and flutes of the series of alternating lobes and flutes are substantially circularly curved in cross section;

centers of the substantially circularly curved lobes are disposed at apexes of a first regular polygon; and centers of the substantially circularly curved flutes are disposed at apexes of a second regular polygon different than the first regular polygon.

15. An electrical connection comprising:

an elongate stud defining a longitudinal axis, the stud comprising an enlarged flange, a shoulder, and a patterned segment, the shoulder being located between the flange and the patterned segment, the shoulder having concave and convex regions alternating circumferentially relative to a longitudinal axis of the stud;

an eyelet having a polygonal aperture therethrough; and a fastener removably secured to the stud, the fastener having an enlarged section operably enclosing at least a portion of the shoulder of the stud, wherein:

the polygonal aperture of the eyelet defines an inscribed diameter and a circumscribed diameter that is larger than the inscribed diameter, and the shoulder defines a circumscribed diameter of the shoulder that is larger than the inscribed diameter of the eyelet and smaller than the circumscribed diameter of the eyelet;

the concave regions of the shoulder contact adjacent sides of the polygonal aperture of the eyelet; and the convex regions of the shoulder are spaced apart from corners formed between the adjacent sides of the polygonal aperture of the eyelet.

16. The electrical connection of claim 15, wherein the patterned segment of the stud comprises at least one spiral thread.

17. The electrical connection of claim 16, wherein the fastener is a rotatable nut having an internal thread operably selectively engagable with the at least one spiral thread of the stud.

18. The electrical connection of claim 17, wherein:

the fastener comprises a radially outwardly directed flange member having a different shape than the enlarged section of the fastener, the flange member being substantially cylindrical and coaxially aligned with the enlarged section.

19. The electrical connection of claim 15, wherein the enlarged flange of the stud defines a circular periphery coaxially aligned with the longitudinal axis of the stud.

20. The electrical connection of claim 15, wherein the stud further comprises a weldable segment located on a side of the flange of the stud opposite from the shoulder.

21. The electrical connection of claim 15, wherein the shoulder comprises eight convex regions and eight convex regions.

22. A grounding stud apparatus for use with an associated eyelet having a polygonal aperture therethrough and an associated nut having a hole therethrough defining an internally threaded section, the apparatus comprising:

an elongate substantially cylindrical body member defining a longitudinal centerline;

a threaded segment having an outer surface defining a thread spiraling around the longitudinal centerline of the body member, the threaded segment being configured for selective coupling with the internally threaded section of the associated nut;

a flange directed radially outwardly relative to the longitudinal centerline of the body member; and a shoulder disposed between the flange and the threaded segment, the shoulder comprising an outer continuous undulating surface comprising a set of circumferentially alternating concave and convex sectors surrounding the longitudinal centerline and that are configured to be received into the polygonal aperture for engaging with the eyelet, the undulating surface being arranged circumferentially uninterrupted relative to the longitudinal centerline, wherein:

the polygonal aperture of the eyelet defines an inscribed diameter and a circumscribed diameter that is larger than the inscribed diameter, and the shoulder defines a circumscribed diameter of the shoulder that is larger than the inscribed diameter of the eyelet and smaller than the circumscribed diameter of the eyelet;

the concave sectors of the shoulder contact adjacent sides of the polygonal aperture of the eyelet; and the convex sectors of the shoulder are spaced apart from corners formed between the adjacent sides of the polygonal aperture of the eyelet.

23. The grounding stud apparatus according to claim 22, wherein:

the set of circumferentially alternating concave and convex sectors define a corresponding set of circumferentially alternating lobes whose cross sections each form a fraction of a first circle and flutes whose cross sections each form a fraction of a second circle, the circumferentially alternating lobes and flutes defining a substantially multilobular cross sectional shape.

24. The grounding stud apparatus according to claim 22, wherein:

the continuous undulating surface defines a corresponding set of one or more circumferentially alternating i) lobes whose one or more cross sections each form a fraction of a first ellipse; and ii) flutes whose one or more cross sections each form a fraction of a second ellipse, the circumferentially alternating one or more lobes and one or more flutes defining a substantially multilobular cross sectional shape.

* * * * *